US005540176A

United States Patent [19]

Galea

[11] Patent Number: 5,540,176

[45] Date of Patent: Jul. 30, 1996

[54] EASILY CONVERTIBLE COMBINATION SPRAYSKIRT AND COCKPIT COVER

[75] Inventor: Joseph A. Galea, Gloversville, N.Y.

[73] Assignee: JAG Manufacturing, Inc., Johnstown, N.Y.

[21] Appl. No.: 497,093

[22] Filed: Jun. 30, 1995

[51] Int. Cl.[6] ..... B63B 17/00

[52] U.S. Cl. ..... 114/361; 114/347

[58] Field of Search ..... 114/347, 361

[56] References Cited

U.S. PATENT DOCUMENTS

| | | | |
|---|---|---|---|
| 333,391 | 12/1885 | Casaday . | |
| 349,316 | 9/1886 | Nye . | |
| 583,033 | 5/1897 | Danz, 2d . | |
| 1,284,968 | 11/1918 | Anderson . | |
| 4,583,480 | 4/1986 | Hamilton et al. | 114/347 |
| 5,331,915 | 7/1994 | Snyder | 114/347 |
| 5,367,975 | 11/1994 | Hamilton et al. | 114/347 |

FOREIGN PATENT DOCUMENTS

| | | | |
|---|---|---|---|
| 1581590 | 12/1980 | United Kingdom | B63B 17/00 |

*Primary Examiner*—Jesus D. Sotelo
*Attorney, Agent, or Firm*—Heslin & Rothenberg, P.C.

[57] ABSTRACT

A sprayskirt for a watercraft, such as a kayak, having a cockpit opening formed therein, includes a shell having a first open end sized for accommodating a person's torso therein and a second open end sized so as to facilitate attachment to the cockpit opening of the kayak. A semi-rigid or rigid member defines a peripheral boundary of the sprayskirt shell, wherein the semi-rigid member has an elasticity so that it tends to recover to the first peripheral boundary after having been deformed. An attachment means secures the second open end of the shell to the raised rim of the kayak for creating a substantially watertight seal between the second open end of the sprayskirt shell and the rim of the kayak. The semi-rigid or rigid member comprises a rod attached to the shell, where the rod defines the peripheral boundary. The rod forms a closed loop and is circular in cross-section. An extension member may be permanently attached to the shell, extending away from the peripheral boundary of the shell. Alternatively, the extension member may be removably attachable to the peripheral boundary of the shell. A removable cover may also be employed with the present invention. The extension member and the cover of the present invention provides a simple and easy apparatus for converting between a sprayskirt and a cover.

22 Claims, 4 Drawing Sheets

EASILY CONVERTIBLE COMBINATION SPRAYSKIRT AND COCKPIT COVER

BACKGROUND OF THE INVENTION

1. Technical Field

The present invention generally relates to protective coverings for open watercraft. More particularly, the present invention relates to sprayskirts and coverings employed in open vessels like kayaks and canoes for preventing the entry of water and other contaminants into the cockpit or interior of the vessels. Even more particularly, the present invention relates to a sprayskirt for the cockpit opening of a kayak or canoe which is easily convertible to a cockpit cover, and vice versa.

2. Background Information

Typically, kayaks and other small open watercraft have cockpit openings to accommodate the seating or kneeling of a person therein. The cockpit is the interior portion of the vessel defined by the lower hull and the upper deck thereof. In a conventional kayak, the cockpit opening is centrally formed in the upper deck of the vessel, and is sized for ingress and egress of the operator. The size and shape of the cockpit opening, however, depends largely on the type and make of the kayak. Other small watercraft, e.g., conventional canoes, do not have cockpit openings formed in the upper deck of the vessel, but instead, have the entire upper portion of the canoe open. The open interior of a conventional canoe is defined by its gunwale or rim.

Largely for competitive and recreational purposes, kayaks and other small watercraft are often employed in turbulent conditions, i.e., white-water conditions. Under such turbulent and rapid conditions, water often splashes over and onto the upper deck of the vessel, often times coming into contact with the operator. Furthermore, white-water conditions often force the vessel on its side, and at times, to flip completely upside down. In order to prevent the entry of water through the cockpit opening of the vessel and into the cockpit during operation, sprayskirts are typically employed. A longstanding quality manufacturer of such sprayskirts is JAG Manufacturing, Inc., located in 203 Jansen Avenue, Johnstown, N.Y. 12095.

During the operation of a kayak, one end of a sprayskirt usually fits snugly around the torso or waist of the operator while the opposing end is elastically or otherwise secured to the rim of the cockpit opening. Because the sprayskirt spans the entire open area of the cockpit opening, water is deflected and prevented from entering through the cockpit opening and into the cockpit.

Furthermore, during the storage and transport of such watercraft, it is often necessary to cover the cockpit opening for reasons other than to prevent the entry of water therein. For instance, while storing a watercraft for any period of time, certain undesirable external elements, such as dirt, insects, and animals may enter into the cockpit of the kayak if left uncovered. Therefore, it is often desirable to employ a cockpit cover during storage. Also, during kayak transport, i.e., on the roof of a car or on a trailer, wind resistance or drag is substantially increased when the cockpit opening is left uncovered. In order to reduce and keep the wind resistance to a minimum, a cockpit cover is typically utilized. Furthermore, when the kayak or other small watercraft is not in use, the cockpit or interior of the vessel may be exposed to the sun, which may cause or hasten deterioration of the interior of the kayak. Accordingly, cockpit covers often are employed to reduce the amount of sun exposure to the interior of the vessel.

As detailed above, in order to prevent the entry of water into the cockpit or interior of a kayak or other small watercraft during operation of the vessel, sprayskirts are usually employed. In addition, separate cockpit covers are often employed when covering the cockpit opening of the vessel during non-operation. Because of the separate and distinct, albeit related, functions performed by a sprayskirt and a cockpit cover, it is commonplace for a boat owner to have a separate sprayskirt and a separate cockpit cover for performing their functions. While there are devices in existence which perform the dual functions stated above, they are cumbersome and costly. Up until now, there has been no known device which simply and easily combines the functions of both a sprayskirt and a cockpit cover and permits easy conversion therebetween.

Thus, a need exists for a combination sprayskirt and cockpit cover which is easily convertible between one and the other. The structure of the present invention contains a solution to the aforementioned problems.

SUMMARY OF THE INVENTION

Briefly, the present invention satisfies this need and overcomes the shortcomings of the prior art through the provision of an easily convertible combination sprayskirt and cockpit cover, which includes a shell having a first open end sized for accommodating a person's torso therein and a second open end sized for attachment to the raised rim of a watercraft. A semi-rigid member may define a peripheral boundary of the shell, with the semi-rigid member having an elasticity so that it tends to recover to the peripheral boundary after having been deformed. Alternatively, a rigid member may define the peripheral boundary of the shell. Means for attaching the second open end of the shell to the raised rim of the kayak creates a substantially watertight seal between the shell and the rim of the watercraft.

Preferably, the semi-rigid or rigid member comprises a rod which is attached to the shell by inserting it into a channel extending around the peripheral boundary of the shell. The semi-rigid or rigid member may comprise any closed loop shape, and the rod is preferably circular in cross-section.

It is therefore a primary object of the present invention to provide an apparatus which combines the functions of both a sprayskirt and cockpit cover.

It is another object of the present invention to provide a combination sprayskirt and cockpit cover which provides an easy conversion from a sprayskirt during use of the water vessel to a cockpit cover during non-use of the vessel, and vice versa.

It is yet another object of the present invention to provide a sprayskirt for an open interior water vessel like a conventional canoe.

It is still another object of the present invention to provide a versatile sprayskirt which permits simple attachments thereto so as to perform varied functions.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description taken in conjunction with the accompanying drawings in which:

DETAILED DESCRIPTION OF THE PREFERRED EMBODIMENTS

It will be readily apparent that the components of the present invention, as generally described and illustrated in the figures, could be arranged and designed in a wide variety of different configurations. Thus, the following detailed description of the presently preferred embodiments of the easily convertible combination cockpit cover and sprayskirt of the present invention, as represented in FIGS. 1–9, is not intended to limit the scope of the invention, as claimed, but is merely representative of the presently preferred embodiments of the invention. The presently preferred embodiments of the invention will be best understood by reference to the drawings, where like parts are designated with like numerals.

Figure 1:
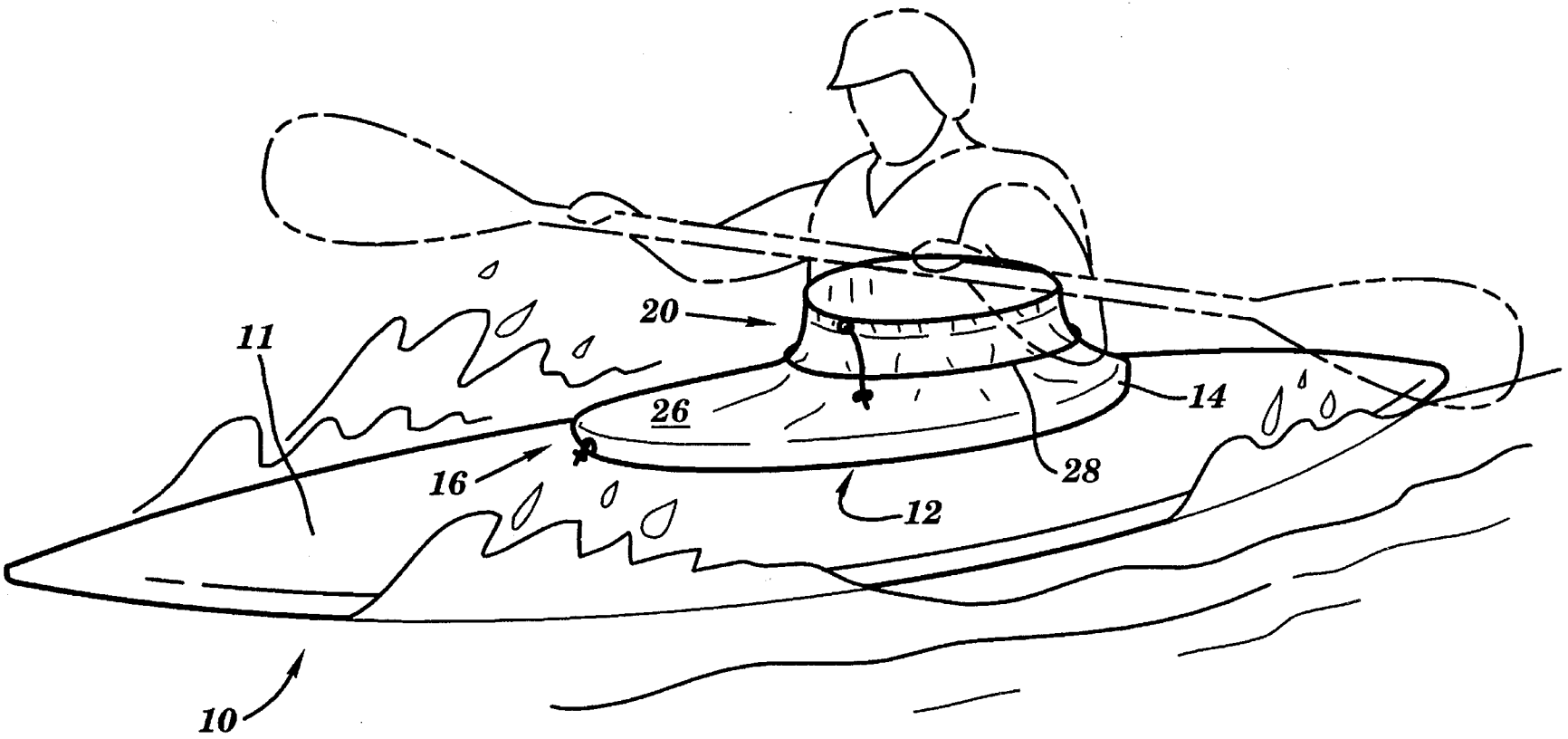
FIG. 1 is a perspective view illustrating a kayak being used in conjunction with a sprayskirt constructed in accordance with the principles of the present invention.
Figure 5:
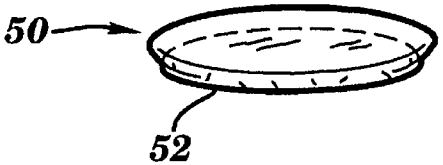
FIG. 5 is a perspective view of a removable cover constructed in accordance with the present invention for removable attachment to the sprayskirts shown in FIGS. 2 and 3.

In reference to the drawings, and more particularly to FIG. 1, there is shown in accordance with the principles of the present invention a watercraft, i.e., a kayak 10 with an operator seated in a cockpit opening 12 thereof. FIG. 1 shows an environment of the kayak during operation, with water splashing onto an upper deck 11 of kayak 10 and onto the operator of the kayak. Typically, as shown best in FIGS. 6–7, cockpit opening 12 includes a raised rim 14 with a channel 16 formed around the periphery of opening 12 so as to facilitate the attachment of a sprayskirt 20 thereto.

Figure 2:
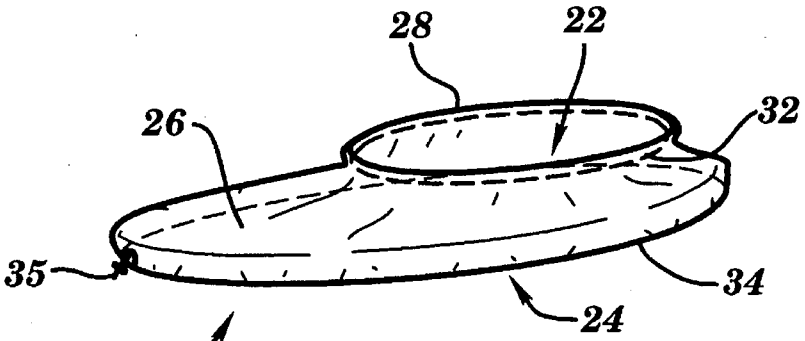
FIG. 2 is a perspective view of one embodiment of a sprayskirt constructed in accordance with the principles of the present invention.

A first embodiment of sprayskirt 20 is shown in FIG. 2 where sprayskirt 20 includes a first open end 22 and a second open end 24. First open end 22 is sized to accommodate a person's torso in the interior of the shell, and second open end 24 is sized to facilitate attachment to rim 14 of kayak 10. Typically, first open end 22 will be considerably smaller than second open end 24 because of the relative small size of a person's torso in comparison to a typical cockpit opening of a kayak.

Sprayskirt 20 includes a shell 26, which is preferably fabricated from a deformable fabric material, such as nylon, or from any other suitable material, such as neoprene. The material selected for shell 26 of sprayskirt 20 should have good waterproof characteristics for preventing the penetration of water therethrough and into the cockpit of kayak 10 during operation. If nylon is selected, it is recommended that a waterproof coating, such as urethane, be applied to the shell to achieve sufficient waterproofing.

At the uppermost extent of sprayskirt 20, a member 28 may define a peripheral boundary of shell 26. Preferably, member 28 is semi-rigid, having an elasticity or flexibility, so that when member 28 deforms, it tends to recover to its original shape. Alternatively, member 28 may be rigid or hard. However, from a manufacturing standpoint, it is preferable to employ a semi-rigid material with good memory characteristics for member 28. It is also important that semi-rigid member 28 have sufficient rigidity so as to facilitate the attachment of removable members, the details of which will be more fully hereinafter described.

Preferably, member 28 comprises a rod shaped to form the peripheral boundary of shell 26 and conducive to returning to its original shape after deformation. Preferably, the rod is fabricated from a high density polyethylene. It should be noted, however, that any material which achieves the abovestated function, i.e., flexibility yet rigidity, may be employed for the semi-rigid member. For instance, instead of utilizing a rod fabricated of high density polyethylene, any suitable material, such as metal or wood, may be substituted therefor. Also, if a rigid material is desired for member 28, any known material having the desired characteristics may be selected. Preferably, the cross-section of rod 26 is circular in shape, but other cross sectional configurations may be employed.

Member 28 is attached to shell 26 so as to form the peripheral boundary thereof and may be attached by any known means. If a cylindrical rod is selected as member 28, it may be inserted or sewn into a channel 32 extending around the periphery of shell 26. Other means of attachment may also be utilized, including, for example, bonding by epoxy.

As shown in FIG. 2, member 28 defines a closed loop, resembling a circle or ring. Other shapes and sizes, however, may be equally desirable. For example, it may be desirable to form member 28 in an oval or rectangular shape. Furthermore, depending on the size of the vessel and/or the size of its operators, loops of varying sizes will be desirable. Therefore, it should be understood that member 28 may be formed in nearly any shape or configuration depending on the specific purpose and use for sprayskirt 20. As stated above, from a manufacturing standpoint, it is preferable that member 28 be semi-rigid. Because various shapes and sizes of the closed loops will be desirable, a semi-rigid member having versatility in form, as compared to a rigid member, provides greater ease of manufacture for sprayskirt 20 and is more cost effective.

Located at the lowermost portion of shell 26 is second open end 24, which is shaped and sized for easy attachment to rim 24 of kayak 10. Second open end 24 is configured for facilitating a substantially water-tight seal between sprayskirt 20 and rim 14 of kayak 10, and therefore includes any known means for attachment, such as an elastic member, e.g., an adjustable elastic shockcord 34, which may be sewn into a channel (not shown) formed around the periphery of second open end 24. By employing adjustable elastic shockcord 34, the size of second open end 24 may be easily and adjustably sized for facilitating a snug and substantially watertight seal to rim 14 of kayak 10. Any other known attachment means may also be substituted for adjustable elastic shockcord 34. For instance, second open end 24 may have an elastic shockcord or other elastic material formed integral or bonded to shell member 26.

Figure 3:
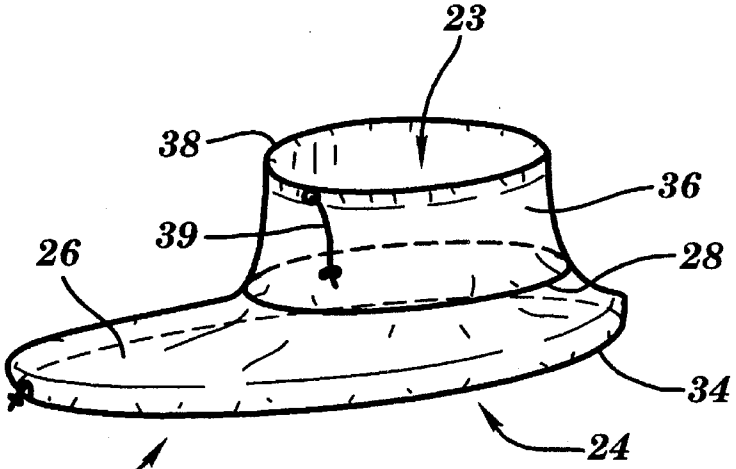
FIG. 3 is a perspective view of another embodiment of a sprayskirt of the present invention, including an extension member fixedly attached thereto.

In reference now to FIG.3, sprayskirt 20 may include a fixedly attached extension member 36 extending away from member 28. In FIG. 3, extension member 36 is shown extending upwardly from member 28. Any means of attachment may be employed to attach extension member 36 to shell 26. For instance, extension member 36 may be sewn to shell 26 or formed integral to shell 26. When sewn to shell 26, extension member 36 should be sewn to the interior of shell 26 so as to not interfere with the operation of member 28, the details of which will be described hereinafter.

Extension member 36 may include means for adjustably sizing a first opening 23—such as an elasticized band 38—so as to facilitate a snug fit to a person's torso. Elasticized band 38 typically will include a hand strap 39 for easily adjusting the size of first opening 23. A tight fit insures that a substantially watertight seal is created between extension member 36 and the person's torso or waist, which in turn prevents the entry of water through the cockpit opening 12 and into the cockpit of kayak 10 during operation.

Figure 6:
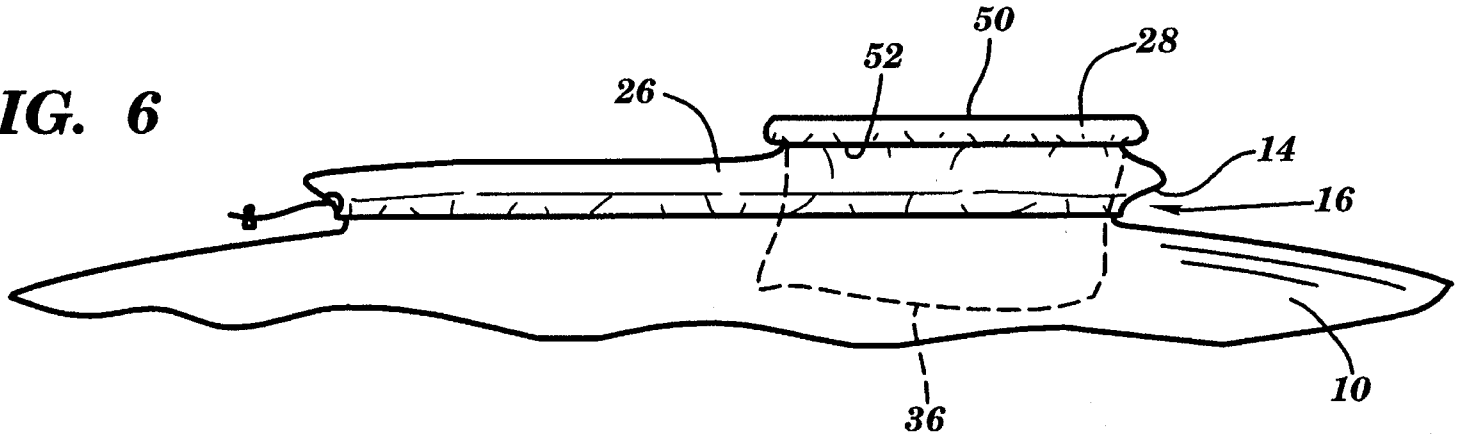
FIG. 6 is a side elevation view of the sprayskirt as depicted in FIG. 3 having the cover shown in FIG. 5 removably attached thereto and showing the extension member tucked into the interior of the shell in phantom.

As illustrated in FIG. 6, extension member 36 may extend down into the internal cavity of sprayskirt 20. By tucking extension member 36 into the internal cavity, member 28 may be disposed at the uppermost boundary, i.e., the peripheral boundary, of sprayskirt 20. Thus, when tucked down into the internal cavity of sprayskirt 20, the sprayskirt of FIG. 3 outwardly resembles the sprayskirt as illustrated in FIG. 2. An arrangement whereby extension member 36 is tucked down into the internal cavity facilitates the attachment of a removable cover 50 (FIG. 6) or a removable extension member 40 (FIG. 7) to sprayskirt 20.

Figure 4:
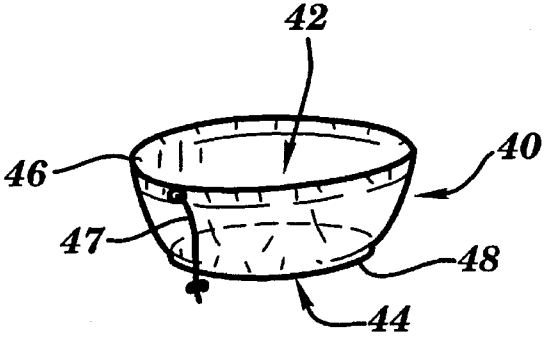
FIG. 4 is a perspective view of a removable extension member constructed in accordance with the present invention for attachment to the sprayskirts shown in FIGS. 2 and 3.

A removable extension member 40, which may be removably attached to semi-rigid member 28 of sprayskirt 20, is illustrated in FIG. 4. Typically, removable extension member 40 is for use with the sprayskirt 20 as illustrated in FIG. 2 which does not include an existing and permanently attached extension member. However, removable extension member 40 may also be desired when the extension member permanently attached does not accommodate a particular sized operator or is made of a material not conducive to a specific outing. For example, a sprayskirt like the one shown in FIG. 3 may include permanently attached extension member 36 which is sized for an operator with a short torso. In the event that an operator with a long torso desired to use this sprayskirt, a removable extension member, sized for such a person, may also be employed.

In reference to FIG. 4, removable extension member 40 resembles a hollow tubular member, and includes a first opening 42 and a second opening 44. Like shell 26 of sprayskirt 20, removable extension member 40 is preferably fabricated from a deformable and substantially waterproof material. It should be noted that removable extension member 40 may be fabricated of many different shapes, sizes, lengths and materials, depending on, for example, the size and height of the operator and the purpose for which the extension member is to be employed. For instance, in cold weather conditions, an extension member having a greater than usual length and made of neoprene or other highly insulated material may be desired. However, in warm weather, and under nonturbulent water conditions, a shorter extension member made of a thin material like nylon may be desired.

First opening 42 of removable extension member 40 may be adjustably sized to snugly fit around the torso or waist of the operator of kayak 10. Accordingly, first opening 42 may include a means for adjusting the size thereof, i.e., an adjustable elasticized band 46, and has a hand strap 47 for the easy tightening and loosening of the elasticized band. Second opening 44 is configured for removable attachment to shell 26, i.e., to the peripheral boundary of shell 26 as defined by member 28. Therefore, second opening 44 may be formed of an attachment means, e.g., an elastic shockcord 48. The size of second opening 44 of extension member 40 when expanded to its outermost perimeter may be smaller than first opening 42 so as to facilitate attachment to member 28.

Figure 7:
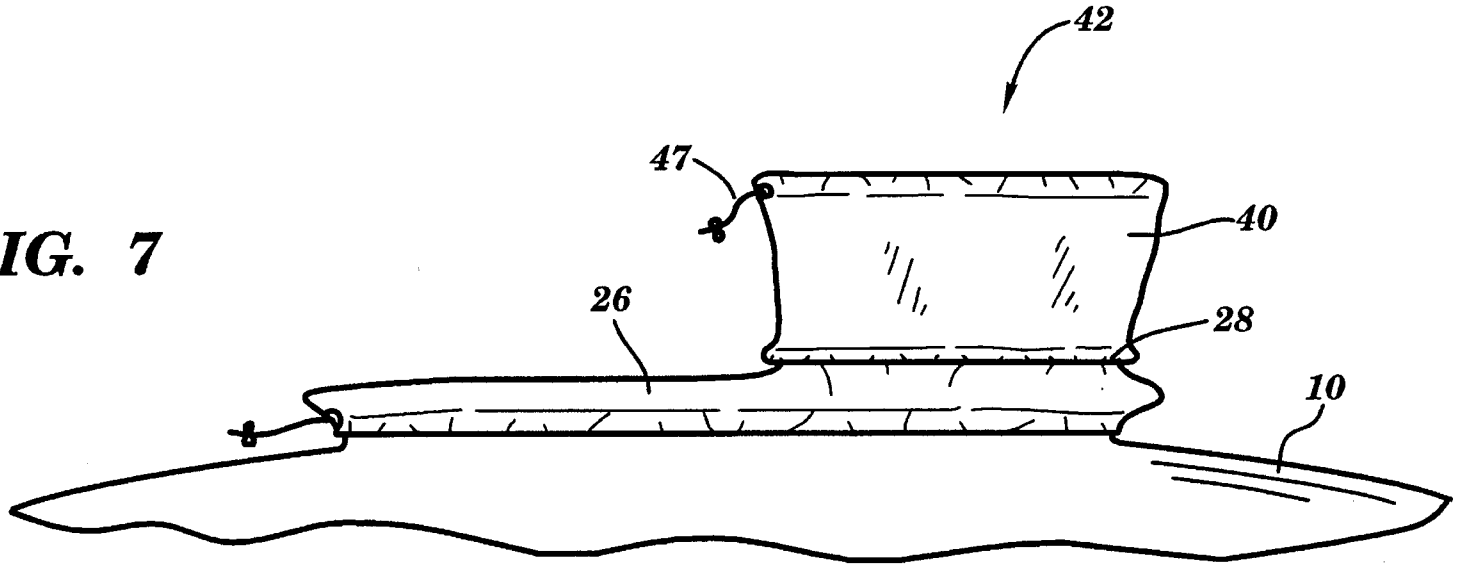
FIG. 7 is a side elevation view of the sprayskirt as shown in either FIGS. 2–3, having the extension member shown FIG. 4 removably attached thereto.

As illustrated in FIG. 7, removable extension member 40 may be removably and easily attached to shell 26, i.e., to member 28. In attaching removable extension member 40 to member 28, the periphery of second opening 44 of extension member 40 may be fitted about the peripheral boundary as defined by member 28. Because the periphery of second opening 44 is elasticized and has a smaller diameter than the peripheral boundary of shell 26, it can be stretched to fit around member 28. Once the elastic shockcord 48 is stretched over member 28, it will be securely fastened thereto, which in turn prevents the entry of water into the cockpit of kayak 10 during operation.

A removable cover 50 may also be used in accordance with the principles of the present invention for covering the cockpit opening of kayak 10, typically during non-use. More specifically, a removable cover may be attached to member 28 in the same way as removable extension member 44 is attached. As separately depicted in FIG. 5, removable cover 50 includes an attachment means, such as an elastic member, e.g., ah elastic shockcord 52 or any other means of attachment, e.g., snap fasteners, for attaching cover 50 to sprayskirt 20. As shown in FIG. 6, removable cover 50 may be easily and removably attached to member 28. In attaching removable cover 50 to member 28, elastic shockcord 52 of the cover 50 is stretched and fitted around the outer peripheral boundary as defined by member 28, thereby creating a snug fit between cover 50 and shell 26, which in turn insures to reduce wind resistance during the transport of kayak 10 and to prevent the entry of external contaminants into the cockpit of kayak 10 during storage.

Figure 8:
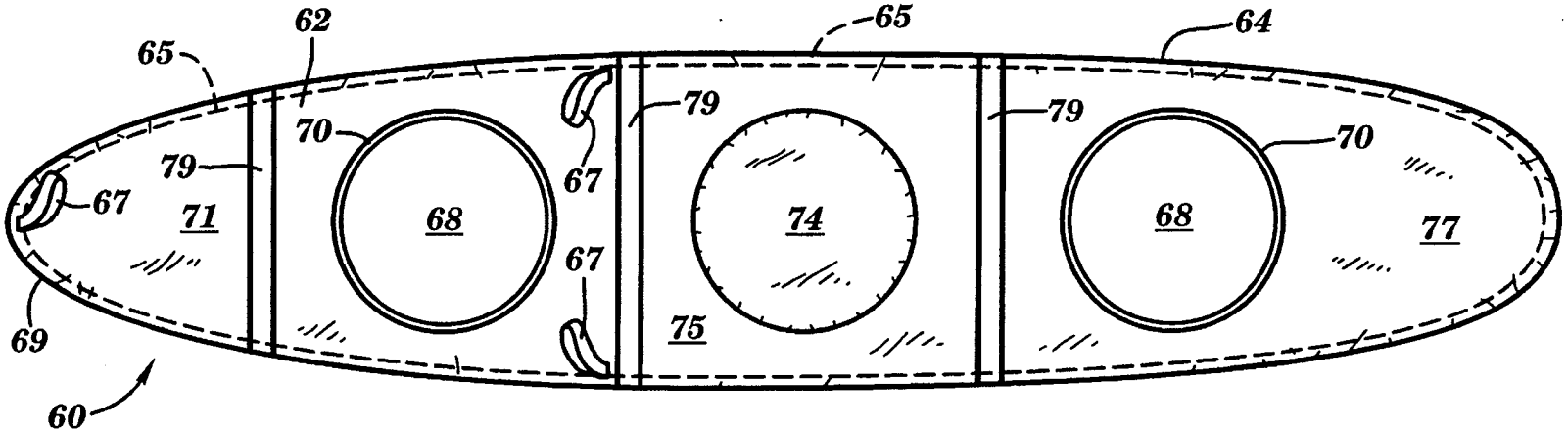
FIG. 8 is a top view illustrating another embodiment of a sprayskirt for use with an open interior vessel like a canoe and constructed in accordance with the principles of the present invention.
Figure 9:
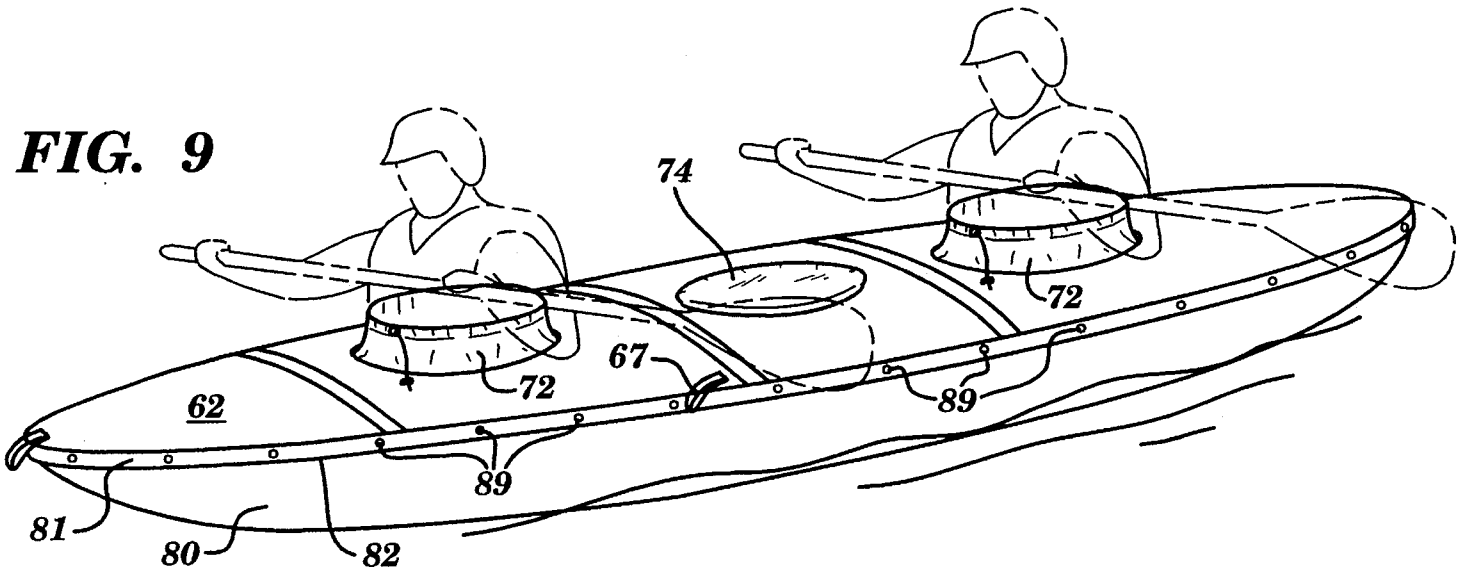
FIG. 9 is a perspective view of the sprayskirt of FIG. 8 as used in conjunction with a canoe and having two operators positioned therein.

Another embodiment of the present invention, as illustrated in FIGS. 8–9, FIGS. 8–9, is a sprayskirt 60 for a watercraft having its entire interior open, like a conventional canoe 80, which does not have a cockpit opening formed therein. The sprayskirt 60 includes a shell which spans the entire area of the open interior of canoe 80. Sprayskirt 60 includes a outside edge 64 which corresponds in size and shape to a rim 82 or perimeter of canoe 80.

Outside edge 64 includes a fastening means for attaching shell 62 to canoe 80. Typically, the fastening means comprises a plurality of snap fasteners 89 evenly spaced around the perimeter of shell 62 and the outside rim of canoe 80. One or more hand grips 67 may also be employed for easy removal of sprayskirt 60 from canoe 80. Shell 62 of sprayskirt 60 may also be divided into separate sections 71, 73, 75, and 77, which are divided by transverse strips 79. Each separate section may include means for attachment and detachment to an adjacent section.

As shown in FIGS. 7–8, a plurality of openings 68 may be formed in shell 62. Like the sprayskirts described above, a member 70, either semi-rigid or rigid, forms the peripheral boundary of each opening 68. Each opening 68 is sized for accommodating a person's torso therein. By providing a plurality of openings 68 in shell 62, canoe 80 may be employed like a conventional kayak in turbulent white-water conditions.

As illustrated in FIG. 8, three openings 68 are shown in use with canoe 80. While three openings 68 are illustrated in FIG. 8, it should be understood, however, that the number of openings in shell 62 are not limited to any specific number, but may differ depending upon numerous factors, for example, the desired number of operators for use with a particular vessel. FIG. 9 shows two operators positioned in the front and rear openings 68 of sprayskirt 60. The center opening 68 is left vacant. Both operators are utilizing attached extension members 72 in the upright position so as to prevent the entry of water into the interior of canoe 80. Extension member 72 may be of the kind which is either removable or permanently attached thereto. The opening 68 positioned in the center of shell 62 includes a removable cover 74 attached to the corresponding member 70 for preventing water from entering the interior of canoe 80. Furthermore, the center opening 68 may De employed to access the interior of the vessel without removal of sprayskirt 60.

By utilizing the sprayskirt 60 on canoe 80, a conventional canoe may be utilized in white-water conditions, without the entry of water into the interior of the vessel. In addition, sprayskirt 60 permits numerous users to permit canoe 80 to be utilized in an unconventional manner.

While several aspects of the present invention have been described and depicted herein, alternative aspects may be effected by those skilled in the art to accomplish the same objectives. For example, while member 28 is shown as a rod configured in a closed loop, it should be understood that member 28 may be fabricated from any known material which facilitates the restoration of the original shape after deformation. Also, while it is preferable that member 28 be semi-rigid, a rigid or hard member 28 may be equally satisfactory for attaching removable covers, removable extension members, or other accessories. Furthermore, the sprayskirts described herein can be configured in an endless number of configurations, e.g., as described herein with the cockpit of a kayak, and as described with the open interior of a canoe. However, other configurations are also possible. The sprayskirts described herein may also be employed in two-man kayaks and should not be limited to one-man constructions. Accordingly, it is intended by the appended claims to cover all such alternative aspects as fall within the true spirit and scope of the invention.

What is claimed:

1. A sprayskirt for a watercraft having a cockpit opening formed therein, said cockpit opening having a raised rim formed around a periphery thereof, said sprayskirt comprising:

a shell having a first open end sized for accommodating a person's torso therein and a second open end sized so as to facilitate attachment to said raised rim of said watercraft;

a semi-rigid member defining a peripheral boundary of said shell, said semi-rigid member having an elasticity so that said semi-rigid member tends to recover to said peripheral boundary after having been deformed; and means for attaching said second open end of said shell to said raised rim of said watercraft so as to create a substantially watertight seal between said second open end of said shell and said rim of said watercraft.

2. The sprayskirt of claim 1, wherein said semi-rigid member comprises a rod attached to said shell, said rod defining said peripheral boundary and said first open end.

3. The sprayskirt of claim 2, wherein said rod is configured to define a closed loop.

4. The sprayskirt of claim 3, wherein said closed loop is circular.

5. The sprayskirt of claim 4, wherein said rod is circular in cross-section.

6. The sprayskirt of claim 2, wherein said shell comprises a deformable material, said rod being inserted into a channel formed in said deformable material, said channel extending around a periphery of said shell thereby defining said peripheral boundary and said first open end.

7. The sprayskirt of claim 1 further comprising an extension member attached to said shell, said extension member extending from said peripheral boundary of said shell.

8. The sprayskirt of claim 7, wherein said extension member includes means for adjustably sizing a first opening thereof so as to facilitate a snug fit to a person's torso so that a substantially watertight seal is created between said extension member and the person's torso.

9. The sprayskirt of claim 8 wherein said extension member is removably attachable to said peripheral boundary of said shell.

10. The sprayskirt of claim 9 wherein said extension member includes a second opening formed opposite said first opening, said second opening including means for attachment to said peripheral boundary of said shell.

11. The sprayskirt of claim 10 wherein said attachment means comprises an elastic member extending around the periphery of said second opening.

12. The sprayskirt of claim 1 further comprising a removable cover, said cover including means for removable attachment to said peripheral boundary of said shell.

13. The sprayskirt of claim 12 wherein said removable attachment means comprises an elastic member adapted for facilitating a substantially water-tight seal when said elastic member is attached to said peripheral boundary of said shell.

14. A sprayskirt for a watercraft having a opening formed therein, said opening having a raised rim extending around a periphery thereof, said sprayskirt comprising:

a rigid member configured to define a first open end and sized to accommodate a person's torso therein;

a shell attached to said rigid member and extending from said first open end, said shell defining a second open end;

means to attaching said second open end of said shell to said raised rim of said kayak so as to create a substantially watertight seal between said second open end of said shell and said rim of said kayak.

15. The sprayskirt of claim 14 wherein said rigid member comprises a rod, said rod being configured to define a closed loop.

16. The sprayskirt of claim 14, wherein said sprayskirt further comprises an extension member extending from said first open end.

17. The sprayskirt of claim 16, wherein said extension member is removably attachable to said peripheral boundary of said shell.

18. A covering for an opening of a watercraft, said opening having a rim, said covering comprising:

a shell having at least one opening sized for accommodating a person's torso therein and an outer edge sized so as to facilitate attaching said outer edge to said rim of said watercraft;

a semi-rigid member defining a peripheral boundary of each of said at least one opening formed in said shell, said semi-rigid member having a tendency to recover to said peripheral boundary after having been deformed; and means for attaching said outer edge of said shell to said rim of said watercraft.

19. The covering of claim 18 wherein said semi-rigid member comprises a rod defining said peripheral boundary of said shell.

20. The covering of claim 19 wherein a peripheral channel corresponding to each of said at least one opening is formed in said shell, said rod corresponding to each of said at least one opening being inserted therein.

21. The covering of claim 18 wherein said at least one opening includes an extension member attached thereto, said extension member extending away from said peripheral boundary of said shell.

22. The covering of claim 18 wherein said shell is separable into more than one shell section, said individual sections being detachable from one another.

* * * * *